United States Patent [19]

Leng et al.

[11] Patent Number: 4,784,800

[45] **Date of Patent: * Nov. 15, 1988**

[54] DETERGENT COMPOSITIONS

[75] Inventors: Francis J. Leng; Jacob Lucassen; David A. Reed, all of Merseyside; Philip J. Sams, Cheshire; Peter Winterbotham, Merseyside, all of

[73] Assignee: Lever Brothers Company, New York, N.Y.

[ * ] Notice: The portion of the term of this patent subsequent to Mar. 29, 2005 has been disclaimed.

[21] Appl. No.: 875,428

[22] Filed: Jun. 17, 1986

[30] Foreign Application Priority Data

Jun. 21, 1985 [GB] United Kingdom ..... 8515721

[51] Int. Cl.[4] ..... C11D 1/29; C11D 1/37; C11D 3/43; C11D 17/08

[52] U.S. Cl. ..... 252/548; 252/153; 252/551; 252/552; 252/557; 252/DIG. 4

[58] Field of Search ..... 252/548, 549, 545, 551, 252/552, 554, DIG. 14, 541, 117, 153, 557

[56] References Cited

U.S. PATENT DOCUMENTS

| | | | |
|---|---|---|---|
| 3,175,977 | 3/1965 | Smithson et al. | 252/541 |
| 4,072,632 | 2/1978 | Reed | 252/551 |
| 4,528,128 | 7/1985 | Naik | 252/554 |
| 4,614,612 | 9/1986 | Reilly et al. | 252/551 |

FOREIGN PATENT DOCUMENTS

| | | |
|---|---|---|
| 153333 | 9/1953 | Australia . |
| 160324 | 12/1954 | Australia . |
| 1429637 | 3/1976 | United Kingdom . |
| 2104913 | 3/1983 | United Kingdom . |
| 2105325 | 3/1983 | United Kingdom . |
| 2108520 | 5/1983 | United Kingdom . |
| 2130238 | 5/1984 | United Kingdom . |
| 2133793 | 8/1984 | United Kingdom . |
| 2158455 | 11/1985 | United Kingdom . |
| 2158456 | 11/1985 | United Kingdom . |

*Primary Examiner*—Paul Lieberman
*Assistant Examiner*—Linda D. Skaling
*Attorney, Agent, or Firm*—Milton L. Honig; James J. Farrell

[57] ABSTRACT

Highly concentrated (60–95% active matter) foaming detergent compositions in liquid or gel form contain dialkyl sulphosuccinate, alkyl ether sulphate and/or ethoxylated nonionic detergent, optionally a fatty acid diethanolamide, optionally urea, and a solvent system of water plus optional lower alcohol, the molar proportion of ammonium ions being such that they constitute at least 50 mole % of the total cations, and being such that the dialkyl sulphosuccinate is at least partially in ammonium salt form.

22 Claims, No Drawings

DETERGENT COMPOSITIONS

The present invention relates to foaming liquid detergent compositions based on dialkyl sulphosuccinates together with alkyl ether sulphates and/or ethoxylated nonionic detergents. The compositions of the invention are characterised by having relatively high levels of active detergent, of which a substantial proportion is in ammonium salt form.

Foaming liquid detergent compositions containing dialkyl sulphosuccinates and alkyl ether sulphates are disclosed in a number of prior Unilever patent specifications, of which GB No. 1 429 637 and GB No. 2 130 238A are of especial interest in the present context. Example 5 of GB No. 1 429 637 discloses a liquid composition, containing a total of 25% by weight of active detergent consisting of 12.5% ammonium dioctyl sulphosuccinate and 12.5% ammonium ether sulphate. GB 2 130 238A discloses a number of compositions containing sodium di ($C_6/C_8$ alkyl) sulphosuccinate and ammonium alkyl ether sulphate at ratios of 2:1 and 4:1 and total active detergent levels of 24–40% by weight. Example 3 discloses a composition having a 1:1 ratio of sodium dialkyl sulphosuccinate to ammonium alkyl ether sulphate and a total active detergent level of 25% by weight.

None of the published art in this area relates to highly concentrated compositions containing 60% by weight or more active detergent. The present applicants have encountered considerable difficulties when attempting to formulate highly concentrated products from this combination of detergent-active materials. At concentrations higher than about 50% by weight it becomes difficult to obtain single-phase liquids stable over a reasonable temperature range.

Our copending GB Application No. 85 11698 (publication no. GB No. 2158455-A), filed on 9 May 1985, represents one approach in this area whereby homogeneous liquid compositions containing dialkyl sulphosuccinates and alkyl ether sulphates contain relatively high levels of a lower alcohol, such as ethanol, as a hydrotrope, the ratio of alcohol to water always exceeding a certain critical value which depends on the total active detergent level; this critical value ranged from 0.45–0.47 at 60% active detergent to 0.54–0.58 at 70% active detergent for the particular system studied. The compositions described in the Examples of the aforementioned application contain sodium dialkyl sulphosuccinate and ammonium alkyl ether sulphate, in weight ratios of 1.54:1 to 2:1, sometimes in conjunction with nonionic surfactants, at total active detergent levels ranging from 60 to 72% by weight. These are stable single-phase liquids at ambient temperature but their low-temperature stability is not ideal: their cloud points (the temperatures below which the compositions become turbid owing to phase separation) are generally between 4 and 11° C., which values are sufficiently high for possible winter storage problems to arise. The Example containing the highest proportion of ammonium ions is Example 38, a composition containing 72% active matter in which the molar proportion of the total cations constituted by ammonium ions is about 39%.

A slightly different approach is disclosed in our copending GB Application No. 85 11699 (publication no. GB No. 2158456-A, also filed on 9 May 1985. This application describes and claims compositions in stable translucent gel form, these compositions containing more water and less alcohol than the liquid compositions of GB Application No. 85 11698 and allowing even higher active detergent levels to be achieved. The Examples of GB Application No. 85 11699 disclose compositions containing sodium dialkyl sulphosuccinate and ammonium alkyl ether sulphate, in weight ratios of 1.4:1 to 2.5:1, sometimes in conjunction with nonionic surfactants, at total active detergent levels ranging from 60 to 76% by weight. The highest molar proportion of ammonium ions disclosed, in Example 6, is about 42%.

It has now been discovered that the low-temperature stability of highly concentrated dialkyl sulphosuccinate compositions in liquid or gel form can be dramatically improved by increasing the proportion of the total cations constituted by ammonium ions to such a level that the countercations to the dialkyl sulphosuccinate consist at least partly of ammonium ions. By this means, compositions having acceptable cloud points (3° C. or below, preferably below 0° C.) can be obtained. This substantial improvement is observed only at high active detergent levels, and appears to be peculiar to dialkyl sulphosuccinate-based compositions.

The present invention accordingly provides a homogeneous foaming detergent composition in liquid or gel form, consisting essentially of (a) from 60 to 95% by weight of an active detergent system comprising
  [i] a water-soluble salt of a $C_3$–$C_{12}$ dialkyl ester of sulphosuccinic acid in which the alkyl groups may be the same or different,
  [ii] a $C_{10}$–$C_{18}$ alkyl ether sulphate and/or an ethoxylated nonionic detergent, the ratio of [i] to [ii] being from 20:1 to 1:4, and
  [iii] optionally a $C_{10}$–$C_{18}$ alkyl di($C_2$–$C_3$) alkanolamide, in an amount not exceeding 15% by weight of the whole composition,
(b) from 0 to 12% by weight of urea,
(c) from 2 to 40% by weight of a solvent system consisting essentially of water optionally together with a $C_2$–$C_3$ mono- or polyhydric alcohol, the molar proportion of ammonium ions to total cations being greater than that required to neutralise the anions of any anionic detergent-active material other than dialkyl sulphosuccinate present, and constituting at least 40 mole % of the total cations in the presence of component (iii) and at least 50 mole % of the total cations in the absence of component (iii).

In the compositions of the invention the active detergent system contains two essential ingredients. The first is a water-soluble salt of a dialkyl ester of sulphosuccinic acid, hereinafter referred to for simplicity as a dialkyl sulphosuccinate.

The detergent-active dialkyl sulphosuccinates used in the compositions of the invention are compounds of the formula I:

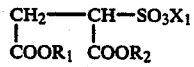

(I)

wherein each of $R_1$ and $R_2$, which may be the same or different, represents a straight-chain or branched-chain alkyl group having from 3 to 12 carbon atoms, preferably from 4 to 10 carbon atoms, and advantageously from 6 to 8 carbon atoms, and $X_1$ represents a solubilising cation, that is to say, a cation yielding a salt of the formula I sufficiently soluble to be detergent-active. In the compositions of the invention the dialkyl sulphosuccinate is, at least in part, in ammonium salt form. The residual cations, if any, will generally be monovalent, for example, alkali metal, especially sodium; or substituted ammonium, for example, ethanolamine. Certain divalent cations, notably magnesium, are however also suitable.

The dialkyl sulphosuccinate component of the composition of the invention may if desired be constituted by a mixture of materials of different chain lengths, of which the individual dialkyl sulphosuccinates themselves may be either symmetrical (both alkyl groups the same) or unsymmetrical (with two different alkyl groups).

The alkyl groups $R_1$ and $R_2$ are preferably straight-chain or (in mixtures) predominantly straight-chain.

Among dialkyl sulphosuccinates that may advantageously be used in the compositions of the invention are the $C_6/C_8$ unsymmetrical materials described and claimed in GB No. 2 105 325B (Unilever); the dioctyl sulphosuccinate/dihexyl sulphosuccinate mixtures described and claimed in GB No. 2 104 913B (Unilever); the mixtures of symmetrical and unsymmetrical dialkyl sulphosuccinates described and claimed in GB No. 2 108 520B (Unilever); and the $C_7/C_8$ and $C_6/C_7/C_8$ dialkyl sulphosuccinate mixtures described and claimed in GB No. 2 133 793A (Unilever).

The dialkyl sulphosuccinate system used in our investigations was a mixture containing $diC_6$, $diC_8$ and $C_6/C_8$ material. Such a mixture may be prepared, as described in the aforementioned GB No. 2 108 520B, by reacting a mixture of n-hexanol and n-octanol with maleic anhydride and subjecting the resulting mixture of dialkyl maleates/fumarates to bisulphite addition.

The concentration of the dialkyl sulphosuccinate component in the whole composition is preferably within the range of from 20 to 65% by weight.

The second essential ingredient of the active detergent system of the composition of the invention is constituted by an alkyl ether sulphate, an ethoxylated nonionic detergent, or a mixture in any proportions of the two. The two essential components (i) and (ii) of the active detergent system are used in a weight ratio of from 20:1 to 1:4, preferably 4:1 to 1:2. The amount of component (ii) present in the composition of the invention is preferably within the range of from 12 to 55% by weight.

The alkyl ether sulphates are materials of the general formula II $$R_3—O—(CH_2CH_2O)_n—SO_3X_2 \text{ (tm) } (II)$$

wherein $R_3$ is an alkyl group having from 10 to 18 carbon atoms and $X_2$ is a solubilising cation, preferably alkali metal, ammonium, substituted ammonium or magnesium, desirably sodium or ammonium. The average degree of ethoxylation n preferably ranges from 1 to 12, preferably from 1 to 8. In any given alkyl ether sulphate a range of differently ethoxylated materials, and some unethoxylated material (alkyl sulphate), will be present and the value of n represents an average. If desired, additional alkyl sulphate may be admixed with the alkyl ether sulphate to give a mixture in which the ethoxylation distribution is more weighted towards lower values.

Advantageously, the alkyl ether sulphate may contain 20% or less by weight of material of chain length $C_{14}$ and above, as described and claimed in GB 2 130 238A (Unilever). Examples of such materials include Dobanol (Trade Mark) 23 ex Shell, based on a mixture of approximately 50% each of $C_{12}$ and $C_{13}$ alcohols, and Lialet (Trade Mark) 123 ex Chimica Augusta, which is more highly branched. The optimum average degree of ethoxylation for alkyl ether sulphates of this preferred type appears to be 2, 3 or 6.5.

The ethoxylated nonionic detergents are materials of the general formula III $$R_4—(C_6H_4)_x—(OCH_2CH_2)_m—OH \text{ (tm) } (III)$$

wherein x is zero (alcohol ethoxylates) or 1 (alkylphenol ethoxylates); $R_4$ is an alkyl group having from 6 to 20 carbon atoms; and m, the average degree of ethoxylation, ranges from 2 to 30. The ethoxylated non-ionic detergent is preferably present at a concentration with respect to the whole composition within the range 12 to 55% by weight. For alcohol ethoxylates, $R_4$ preferably has from 8 to 18, more preferably from 8 to 13, carbon atoms, and m is from 2.5 to 14; for alkylphenol ethoxylates, $R_4$ preferably has from 8 to 12 carbon atoms and m is from 8 to 16. Examples of the former class are Dobanol (Trade Mark) 91-2.5, 91-6 and 91-8 ex Shell ($R_4$ is $C_9$–$C_{11}$, m is 2.5, 6 or 8 respectively); Tergitol (Trade Mark) 15-S-12 ex Union Carbide ($R_4$ is $C_{11}$–$C_{15}$, m is 12); and Rexonic (Trade Mark) N91-6 ex Hart Chemicals ($R_4$ is $C_9$–$C_{11}$, m is 6). An example of the latter class is Nonidet (Trade Mark) P.80 ex Shell ($R_5$ is $C_8$, m is 11).

In the first embodiment of the invention component (ii) consists wholly of alkyl ether sulphate. These compositions have excellent foaming properties. In this embodiment, the molar proportion of ammonium ions to total cations must be greater than that required to neutralise the anions of the alkyl ether sulphate and must constitute at least 50 mole % of the total cations in the absence of component (iii).

In this embodiment, the weight ratio of component (i), the dialkyl sulphosuccinate, to component (ii), the alkyl ether sulphate, is preferably within the range of from 4:1 to 1:1. If no other detergent-active materials are present, the minimum molar percentage of the total cations constituted by ammonium ions required to give good low-temperature stability, as evidenced by a cloud point of 3° C. or below, will increase only slightly as the ratio of dialkyl sulphosuccinate to alkyl ether sulphate is increased. Clearly if this ratio is 1:1 the molar percentage of ammonium ions must exceed 50%, but it appears that about 55% is sufficient. At a 2:1 ratio a minimum of about 56% appears to suffice, while at a 4:1 ratio a minimum of about 65% appears to be required.

Assuming that the alkyl ether sulphate is in 100% ammonium salt form, the molar proportion of component (i) that must be in ammonium salt form varies rather more steeply with the (i) to (ii) ratio. At 1:1, only about 8 mole % of (i) need apparently be in ammonium salt form to achieve a cloud point below 3° C., while at 2:1 about 30 mole % appears to be needed and at 4:1 about 55 mole %. At all these ratios, the cloud points fall as the molar proportion of ammonium ions is increased and the best results are obtained when both active detergents (i) and (ii) are in substantially 100% ammonium salt form.

In a second embodiment of the invention, component (ii) consists of an ethoxylated nonionic detergent. The use of an ethoxylated nonionic detergent rather than an alkyl ether sulphate as component (ii) has the particular advantage that lower levels of hydrotrope (lower alcohol) are required to achieve acceptable low temperature stability. It has also proved possible to attain higher total active detergent contents, partly because lower hydrotrope levels leave more room for active detergent and partly because of the commercial availability of nonionic detergents in 100% active matter form: alkyl ether sulphates are not generally available at active matter contents higher than about 70%.

It is also possible to use mixtures of alkyl ether sulphates and ethoxylated nonionic surfactants, in any proportions, as component (ii), and this constitutes a third embodiment of the invention.

As indicated above, the compositions of the invention (all embodiments) may also contain $C_{10}$–$C_{18}$ di($C_2$–$C_3$) alkanolamide in an amount not exceeding 15% by weight of the whole composition. A preferred level for this material is from 7 to 12% by weight. The $C_{12}$–$C_{14}$ alkyl diethanolamides are especially preferred. Both coconut and the more narrow-cut lauric diethanolamides are commercially available; examples include Empilan (Trade Mark) LDE and CDE ex Albright & Wilson and Ninol (Trade Mark) P.621 ex Stepan Chemical Company.

In the presence of a $C_{10}$–$C_{18}$ alkyl di ($C_2$–$C_3$) alkanolamide the molar proportion of ammonium ions to total cations constitutes at least 40 wt % of the total cations, whilst in the absence of any $C_{10}$–$C_{18}$ alkyl di ($C_2$–$C_3$) alkanolamide the molar proportion of ammonium ions to total cations constitutes at least 50 wt % of the total cations. Preferably however even in the presence of a $C_{10}$–$C_{18}$ alkyl di ($C_2$–$C_3$) alkanolamide the molar proportion of ammonium ions to total cations constitutes at least 50 mole % of the total cations.

It has been found that the inclusion of these diethanolamides is of especial value in compositions according to the first embodiment of the invention, in that it improves the low-temperature stability and reduces the molar proportion of ammonium ions required to achieve a cloud point below 3° C. In a ternary mixture having a (i): (ii): (iii) ratio of 4:2:1 (2:1:0.5), it has been found that only about 40 mole % of the total cations need be ammonium ions; assuming that alkyl ether sulphate to be in 100% ammonium salt form, only about 15 mole % of the dialkyl sulphosuccinate is apparently required to be in ammonium salt form. Again, however, the low-temperature properties improve as the proportion of ammonium ions is increased and the 100% ammonium system appears to be optimal.

The compositions of the invention also contain a solvent system which may be entirely aqueous or may also include a lower alcohol. Depending on the level of the solvent system and its alcohol content, the compositions of the invention may be in liquid or gel form. Compositions according to the first embodiment of the invention will generally require from 5 to 20% by weight of lower alcohol if in liquid form, and from 2 to 10.5% by weight of lower alcohol if in gel form. Compositions according to the second embodiment of the invention generally require less, or even no, lower alcohol: a range of from 1 to 15% by weight is typical. The preferred lower alcohol is ethanol; possible alternatives include isopropanol and glycerol. The detergent-active raw materials used may themselves contain ethanol, and this may be the sole source of ethanol in the compositions of the invention. Similarly, the water present in the compositions of the invention will include, and may consist entirely of, water inherently present in the detergent-active raw materials and the lower alcohol. The various weight percentage levels quoted above are based on anhydrous (100% active matter) material.

Liquid compositions of the invention may if desired be thickened with a polymer, as described in our aforementioned GB Application No. 85 11698. Preferred thickening agents are hydrophilically substituted celluloses and guars.

Urea may also be present at levels not exceeding 12% by weight. This is beneficial to low temperature stability and, surprisingly, also raises the viscosity.

The composition of the invention may also contain the usual minor ingredients well-known to those skilled in the art, for example, colouring, perfume, preservatives and germicides. These in total will not normally constitute more than about 2% by weight of the whole composition.

The invention is further illustrated by the following non-limiting Examples.

EXAMPLES

In the following Examples, the dialkyl sulphosuccinate used was a $C_6$/$C_8$ mixed product, containing about 80% active matter, prepared as described in GB No. 2 108 520B (Unilever) from a mixture of 35 mole % n-hexanol and 65 mole % n-octanol or from a mixture of 40 mole % n-hexanol and 60 mole % n-octanol. To prepare some very highly concentrated compositions, this material was dried to an active matter content of about 94%.

The alkyl ether sulphate used was Dobanol (Trade Mark) 23-3A ex Shell ($C_{12}$–$C_{13}$, 3EO, ammonium salt, about 60% active matter).

The ethoxylated nonionic detergents used were Dobanol 91-8 ex Shell ($C_9$–$C_{11}$, 8 EO, 100% active matter), Tergitol (Trade Mark) 15-S-12 ex Union Carbide , ($C_{11}$–$C_{15}$, 12EO, 100% active matter), and Rexonic (Trade Mark) N91-6 ex Hart Chemicals ($C_9$–$C_{11}$, 6EO, 100% active matter).

The lauric diethanolamide used in Examples 7 to 11 and 46 was Empilan (Trade Mark) LDE ex Albright & Wilson (100% active matter).

The compositions were hydrotroped with ethanol in the form of industrial methylated spirit containing about 91% ethanol; the figures given are for actual ethanol content.

All ingredient levels are quoted as the nominal figures for 100% material.

The compositions prepared, and their cloud points, are shown in the following Tables. Where cations other than ammonium ions were present, the actual molar proportion of total cations constituted by ammonium ions is given; where a non-sulphosuccinate anionic surfactant (alkyl ether sulphate) was present, the notional molar proportion of the dialkyl sulphosuccinate present in ammonium salt form assuming that the alkyl ether sulphate is present in 100% ammonium form is also stated.

Examples 1 and 2 and Comparative Examples A to D relate to the first embodiment of the invention. Each composition contained 64.5% by weight of active detergent consisting of 4 parts by weight of dialkyl sulphosuccinate and 1 part by weight of alkyl ether sulphate. The latter component was in ammonium salt form, and the progression from Comparative Example A to Example 2 shows the effect of increasing the proportion of dialkyl sulphosuccinate present in ammonium salt form, the balance being in sodium salt form. It appears that at this total active detergent level, (i) to (ii) ratio and hydrotrope level, and with sodium as the residual cation, at least about 65 mole % of the total cations should be constituted by ammonium ions.

Examples 3 to 5 and Comparative Examples E to G represent a similar set of results for a 2:1 dialkyl sulphosuccinate to alkyl ether sulphate system, also at a total active detergent level of 64.5% by weight. Here the crossover point appears to occur when more than 55 mole % of the total cations are constituted by ammonium ions. Example 6 shows that a stable composition with a good cloud point can also be obtained at the higher active detergent level of 74%.

Examples 7 to 11 and Comparative Example H illustrate the effect of including lauric diethanolamide. The total active detergent level is again 64.5%, and the ratio of (i):(ii):(iii) is 4:2:1 (2:1:0.5). It will be noted that when lauric diethanolamide is present, acceptably low cloud points are reached at lower proportions of ammonium ions.

Examples 12 to 16 and Comparative Example J relate to the binary dialkyl sulphosuccinate/alkyl ether sulphate system at a ratio of 1:1, again at a total active detergent level of 64.5%. Again the low temperature stability improves as the proportion of ammonium ions increases, at least 50 mole % of ammonium ions being required for an acceptable cloud point.

Examples 17 to 20 and Comparative Examples K to P relate to the second embodiment of the invention in which component (ii) is an ethoxylated nonionic surfactant. These Examples form a series corresponding to that of Examples 3 to 5 and Comparative Examples E to G, and show that at this total active detergent level, (i) and (ii) ratio and hydrotrope level, at least about 55 mole % of the total cations should be constituted by ammonium ions.

Examples 21 to 29 and Comparative Examples Q to V demonstrate that lower hydrotrope (ethanol) levels are required in second-embodiment (dialkyl sulphosuccinate/nonionic detergent) compositions than in first-embodiment (dialkyl sulphosuccinate/alkyl ether sulphate) compositions at similar active detergent levels and ratios, to achieve similar cloud points. It may be seen that for both types of composition the ethanol requirement falls as the total active detergent level rises, but comparison of Example 21 with Example 25 shows that the first-embodiment composition 21 required 10% of ethanol, 9.1% being inadequate, while the similar second-embodiment composition 25 needed only 8%. The same effect can be observed at the higher active detergent levels employed in Examples 22 to 24 and 26 to 29.

Examples 30 to 37 show how very high active detergent levels can be achieved using ammonium dialkyl sulphosuccinate and nonionic detergent at various ratios.

Examples 38 to 40 and Comparative Examples W to Z show the effect of progressively replacing the alkyl ether sulphate by an ethoxylated nonionic detergent at a constant (i) to (ii) ratio of 2:1 and a total active detergent level of 64.5%, and thus illustrate the third embodiment of the invention. Examples 5 and 20 and Comparative Examples E and K have been included to complete the series. When the dialkyl sulphosuccinate was in 100% ammonium salt form, stable liquids with low cloud points were obtained in every case, while with the sodium salt gels and two-phase systems with progressively increasing cloud points were obtained as the proportion of nonionic detergent was increased. These results show how the use of dialkyl sulphosuccinate in ammonium salt form allows nonionic detergents to be used in place of alkyl ether sulphates without loss of stability.

Examples 41 to 45 show the use of nonionic detergent and alkyl ether sulphate together in compositions at the higher total active detergent level of 69.6% by weight. All the compositions had cloud points below −5° C.

Finally, Example 46 shows that lauric diethanolamide can be incorporated in a composition according to the second embodiment of the invention. The total active detergent level was 68%.

| | A | B | C | D | 1 | 2 |
|---|---|---|---|---|---|---|
| Dialkyl sulphosuccinate | | | | | | |
| $NH_4$ salt | — | 8.6 | 17.6 | 25.8 | 34.4 | 51.6 |
| Na salt | 51.6 | 43.0 | 34.4 | 25.8 | 17.2 | — |
| Alkyl ether sulphate ($NH_4$ salt) | 12.9 | 12.9 | 12.9 | 12.9 | 12.9 | 12.9 |
| Ethanol | 13.6 | 13.6 | 13.6 | 13.6 | 13.6 | 13.6 |
| Mole % $NH_4^+$ based on total cations | 20 | 33 | 47 | 60 | 73 | 100 |
| Mole % of dialkyl sulphosuccinate as $NH_4^+$ salt | 0 | 16.7 | 33.3 | 50 | 66.7 | 100 |
| Cloud point (°C.) | +15 | +13.5 | +10.5 | +7 | −3.5 | −6.5 |

| | E | F | G | 3 | 4 | 5 | 6 |
|---|---|---|---|---|---|---|---|
| Dialkyl sulphosuccinate | | | | | | | |
| $NH_4$ salt | — | 7.17 | 14.33 | 21.5 | 28.67 | 43 | 49.3 |
| Na salt | 43 | 35.83 | 28.67 | 21.5 | 14.33 | — | — |
| Alkyl ether sulphate ($NH_4$ salt) | 21.5 | 21.5 | 21.5 | 21.5 | 21.5 | 21.5 | 24.7 |
| Ethanol | 13.6 | 13.6 | 13.6 | 13.6 | 13.6 | 13.6 | 9.0 |
| Mole % $NH_4^+$ based on total cations | 33 | 44 | 55 | 67 | 78 | 100 | 100 |
| Mole % of dialkyl sulphosuccinate as $NH_4^+$ salt | 0 | 16.7 | 33.3 | 50 | 66.7 | 100 | 100 |
| Cloud point (°C.) | +12.5 | +8.5 | +3.5 | −3.5 | −6 | −8 | −3 |

| | H | 7 | 8 | 9 | 10 | 11 |
|---|---|---|---|---|---|---|
| Dialkyl sulphosuccinate | | | | | | |
| $NH_4$ salt | — | 6.14 | 12.29 | 18.43 | 24.58 | 36.87 |
| Na salt | 36.87 | 30.73 | 24.58 | 18.44 | 12.29 | — |
| Alkyl ether sulphate ($NH_4$ salt) | 18.42 | 18.42 | 18.42 | 18.42 | 18.42 | 18.42 |
| Lauric diethanolamide | 9.21 | 9.21 | 9.21 | 9.21 | 9.21 | 9.21 |
| Ethanol | 13.6 | 13.6 | 13.6 | 13.6 | 13.6 | 13.6 |
| Mole % $NH_4^+$ based on total cations | 34 | 44 | 56 | 67 | 78 | 100 |
| Mole % dialkyl sulphosuccinate as $NH_4^{30}$ salt | 0 | 16.7 | 33.3 | 50 | 66.7 | 100 |
| Cloud point (°C.) | +8 | +2 | −0.5 | −4.5 | −6 | <−10 |

| | J | 12 | 13 | 14 | 15 | 16 |
|---|---|---|---|---|---|---|
| Dialkyl sulphosuccinate | | | | | | |
| $NH_4$ salt | 0 | 5.31 | 10.75 | 16.12 | 21.50 | 32.25 |
| Na salt | 32.25 | 26.87 | 21.50 | 16.12 | 10.75 | — |
| Alkyl ether sulphate ($NH_4$ salt) | 32.25 | 32.25 | 32.25 | 32.25 | 32.25 | 32.25 |
| Ethanol | 13.6 | 13.6 | 13.6 | 13.6 | 13.6 | 13.6 |
| Mole % $NH_4^+$ based on total cations | 50 | 58 | 67 | 75 | 83 | 100 |

-continued

| | J | 12 | 13 | 14 | 15 | 16 |
|---|---|---|---|---|---|---|
| Mole % dialkyl sulphosuccinate as $NH_4^+$ salt | 0 | 16.7 | 33.3 | 50 | 66.7 | 100 |
| Cloud point (°C.) | +5.5 | +1 | −2 | −8 | −10 | <−10 |

| | K | L | M | N | P | 17 | 18 | 19 | 20 |
|---|---|---|---|---|---|---|---|---|---|
| Dialkyl sulphosuccinate | | | | | | | | | |
| $NH_4$ salt | 0 | 7.17 | 14.19 | 18.92 | 21.5 | 23.65 | 28.81 | 33.54 | 43.0 |
| Na salt | 43.0 | 35.83 | 28.81 | 24.08 | 21.5 | 19.35 | 14.19 | 9.46 | — |
| Nonionic surfactant (Dobanol 91-8) | 21.5 | 21.5 | 21.5 | 21.5 | 21.5 | 21.5 | 21.5 | 21.5 | 21.5 |
| Ethanol | 13.6 | 13.6 | 13.6 | 13.6 | 13.6 | 13.6 | 13.6 | 13.6 | 13.6 |
| Mole % $NH_4^+$ based on total cations | 0 | 16.7 | 33 | 44 | 50 | 55 | 67 | 78 | 100 |
| Cloud point (°C.) | Two phases (separation of active material as solid) | | 10 | 6 | 4 | −1 | −1.5 | −2.5 | −9.5 |

| | Q | 21 | R | 22 | 23 | S | 24 |
|---|---|---|---|---|---|---|---|
| Dialkyl sulphosuccinate ($NH_4$ salt) | 46.66 | 46.66 | 49.33 | 49.33 | 49.33 | 52.00 | 52.00 |
| Alkyl ether sulphate ($NH_4$ salt) | 23.33 | 23.33 | 24.67 | 24.67 | 24.67 | 26.00 | 26.00 |
| Ethanol | 9.10 | 10.00 | 7.70 | 8.15 | 9.10 | 5.44 | 7.00 |
| Total active detergent | 70.00 | 70.00 | 74.00 | 74.00 | 74.00 | 78.00 | 78.00 |
| Cloud point (°C.) and/or ambient temperature properties | x | −12 | x | −11 | −7 | gel | −4 |

x = phase separation at ambient temperature.

| | T | 25 | U | 26 | 27 | V | 28 | 29 |
|---|---|---|---|---|---|---|---|---|
| Dialkyl sulphosuccinate ($NH_4$ salt) | 46.40 | 46.40 | 51.00 | 51.00 | 51.00 | 53.33 | 53.33 | 53.33 |
| Nonionic surfactant (Dobanol 91-8) | 23.20 | 23.20 | 25.50 | 25.50 | 25.50 | 26.67 | 26.67 | 26.67 |
| Ethanol | 6.00 | 8.00 | 4.00 | 5.10 | 6.00 | 2.65 | 4.00 | 5.29 |
| Total active detergent | 69.60 | 69.60 | 76.50 | 76.50 | 76.50 | 80.00 | 80.00 | 80.00 |
| Cloud point (°C.) and/or ambient temperature properties | x | −8 | x | −5 | −8 | x | 1 | −4 |

x = phase separation at ambient temperature

| | 30 | 31 | 32 | 33 | 34 | 35 | 36 | 37 |
|---|---|---|---|---|---|---|---|---|
| Dialkyl sulphosuccinate ($NH_4$ salt) | 58.42 | 55.00 | 55.03 | 41.25 | 41.25 | 46.48 | 27.47 | 27.47 |
| Nonionic surfactant: | | | | | | | | |
| Dobanol 91-8 | 29.21 | — | — | — | — | 46.48 | — | — |
| Rexonic N91-6 | — | — | 33.30 | — | 50.00 | — | — | 66.70 |
| Tergitol 15-S-12 | — | 33.30 | — | 50.00 | — | — | 66.70 | — |
| Ethanol | 3.00 | 2.04 | 2.04 | 1.52 | 1.52 | 3.00 | 1.00 | 1.00 |
| Total active detergent | 87.64 | 88.30 | 88.33 | 91.25 | 91.25 | 92.96 | 94.17 | 94.17 |
| Ratio (i):(ii) | 2:1 | 1.65:1 | 1.65:1 | 0.82:1 | 0.82:1 | 1:1 | 0.41:1 | 0.41:1 |
| Cloud point (°C.) and/or ambient temperature properties | clear liquid | 0.5 clear liquid | −5.5 clear liquid | clear liquid | clear liquid | slightly cloudy liquid | clear liquid, trace of crystals | clear liquid, trace of crystals |

| | 5,E | 38,W | 39,X | 40,Y | 20,K |
|---|---|---|---|---|---|
| Dialkyl sulphosuccinate ($NH_4$ salt or Na salt) | 43 | 43 | 43 | 43 | 43 |
| Alkyl ether sulphate ($NH_4$ salt) | 21.5 | 16.13 | 10.75 | 5.38 | — |
| Nonionic detergent (Dobanol 91-8) | — | 5.38 | 10.75 | 16.13 | 21.5 |
| Ethanol | 13.6 | 13.6 | 13.6 | 13.6 | 13.6 |
| Cloud point (°C.) and/or ambient temperature properties | | | | | |
| $NH_4$ salt | −8 | −8 | −10 | <−8 | −9.5 |
| Na salt | +12.5 | +13 | — | — | — |
| | | Some separation of semi-crystalline solids in liquid | | | |

| | 41 | 42 | 43 | 44 | 45 |
|---|---|---|---|---|---|
| Dialkyl sulphosuccinate ($NH_4$ salt) | 46.4 | 46.4 | 46.4 | 46.4 | 46.4 |
| Alkyl ether sulphate ($NH_4$ salt) | 23.2 | 17.4 | 11.6 | 5.8 | — |
| Nonionic detergent | — | 5.8 | 11.6 | 17.4 | 23.2 |
| Ethanol | 11.0 | 11.0 | 11.0 | 11.0 | 11.0 |

-continued

| | 41 | 42 | 43 | 44 | 45 |
|---|---|---|---|---|---|
| Cloud point, °C. | −6 | −7 | −8 | <−10 | −6 |

| | |
|---|---|
| Dialkyl sulphosuccinate (ammonium salt) | 38.86 |
| Nonionic surfactant (Dobanol 91-8) | 19.42 |
| Lauric diethanolamide | 9.71 |
| Ethanol | 10.00 |
| Cloud point: | −16° C. |

COMPARATIVE EXAMPLE AA

Samples of Composition 5 and Comparative Composition E (both containing 64.5% active matter) were both diluted with water to an active matter content of 30% by weight Both split into two phases. Further dilution to 20% active matter resulted once more in homogeneous solutions, but both had very high cloud points differing only by 2.5° C.:

Diluted Composition 5: +18° C.

Diluted Composition E: +20.5° C.

Evidently the dilution resulted in hydrotrope levels too low to give stable formulations, but it is nevertheless clear that the change of cation had only a very small effect on the cloud point.

COMPARATIVE EXAMPLE BB

Further samples of Compositions 5 and E were diluted using a different procedure whereby the ethanol content was kept constant at 13.6% by weight. Homogeneous solutions were obtained at both 30% and 20% active matter, but the cloud points differed only marginally:

| | 30% | 20% |
|---|---|---|
| Diluted Composition 5: | +1.5° C. | 0 |
| Diluted Composition E: | +3.5° C. | +2° C. |

These experiments show that at lower concentrations, even when the hydrotrope level is maintained, the choice of cation has little effect on the cloud point. It will be noted that all the diluted samples had cloud points substantially higher than that of undiluted Composition 5 (−8° C.).

We claim:

1. A homogeneous foaming detergent composition in liquid or gel form, consisting essentially of (a) from 64.5% to 95% by weight of an active detergent system comprising

[i] a water-soluble salt of a $C_3$–$C_{12}$ dialkyl ester of sulphosucciinic acid in which the alkyl groups may be the same or different,

[ii] a $C_{10}$–$C_{18}$ alkyl ether sulphate and/or an ethoxylated nonionic detergent, the ratio of [i] to [ii] being from 20:1 to 1:4, and

[iii] optionally a $C_{10}$–$C_{18}$ alkyl di($C_2$–$C_3$) alkanolamide, in an amount not exceeding 15% by weight of the whole composition, (b) from 0 to 12% by weight of urea, (c) from 2 to 40% by weight of a solvent system consisting essentially of water optionally together with a $C_2$–$C_3$ mono- or polyhydric alcohol, the molar proportion of ammonium ions to total cations being sufficient to neutralise at least 8 mole % of the dialkyl sulphosuccinate (i) as well as 100 mole % of any anionic detergent-active material other than dialkyl sulphosuccinate present, and constituting at least 40 mole % of the total cations in the presence of component (iii) and at least 50 mole % of the total cations in the absence of component (iii).

2. A composition as claimed in claim 1, wherein the weight ratio of component (i) to component (ii) is at least 2:1, and at least 55 mole % of the total cation content is constituted by ammonium ions.

3. A composition as claimed in claim 1, wherein the weight ratio of component (i) to component (ii) is at least 2:1, no component (iii) is present and the molar proportion of ammonium ions in the total cations is sufficient to neutralise at least 30 mole % of the dialkyl sulphosuccinate (i) as well as 100 mole % of any other anionic detergent present.

4. A composition as claimed in claim 1, wherein substantially 100% of the total cation content is constituted by ammonium ions.

5. A composition as claimed in claim 1 in which component (iii) is present and the molar proportion of ammonium ions to total cations constitutes at least 50 mole % of the total cations.

6. A composition as claimed in claim 1 which contains from 7 to 12% by weight of the $C_{10}$–$C_{18}$ alkyl di($C_2$–$C_3$) alkanolamide (iii).

7. A composition as claimed in claim 6, wherein the ratio of component (i) to component (ii) is at least 2:1 and the molar proportion of ammonium ions in the total cations is sufficient to neutralise at least 15 mole % of the dialkyl sulphosuccinate (i) as well as 100 mole % of any other anionic detergent present

8. A composition as claimed in any one of claim 1, which contains from 2 to 20% by weight, based on the total composition, of a $C_2$–$C_3$ alcohol in the solvent system (c).

9. A composition as claimed in claim 8, which is in the form of a homogeneous liquid and contains from 12 to 20% by weight of the $C_2$–$C_3$ alcohol.

10. A composition as claimed in claim 9, which is in gel form and contains from 2 to 9% by weight of the $C_2$–$C_3$ alcohol.

11. A composition as claimed in claim 1, wherein the $C_2$–$C_3$ alcohol comprises ethanol.

12. A composition as claimed in claim 1, wherein the dialkyl sulphosuccinate (i) comprises material of at least two different alkyl chain lengths.

13. A composition as claimed in claim 12, wherein the dialkyl sulphosuccinate (i) comprises a mixture of symmetrical and unsymmetrical dialkyl sulphosuccinates.

14. A composition as claimed in claim 1, wherein the dialkyl sulphosuccinate (i) consists wholly or predominantly of straight-chain material.

15. A composition as claimed in claim 1, wherein the alkyl groups of the dialkyl sulphosuccinate (i) each have from 4 to 10 carbon atoms.

16. A composition as claimed in claim 15, wherein the alkyl groups of the dialkyl sulphosuccinate (i) each have from 6 to 8 carbon atoms.

17. A composition as claimed in claim 1, wherein the total active detergent concentration is within the range of from 65 to 75% by weight.

18. A composition as claimed in claim 1, wherein the weight ratio of component (i) to component (ii) is within the range of from 4:1 to 1:2.

19. A composition as claimed in claim 18, wherein the weight ratio of component (i) to component (ii) is within the range of from 2:1 to 1:1.

20. A composition as claimed in claim 1, wherein the concentration of the dialkyl sulphosuccinate (i) in the whole composition is within the range of from 20 to 65% by weight.

21. A composition as claimed in claim 1, wherein the concentration of the alkyl ether sulphate (ii) in the whole composition is within the range of from 12 to 55% by weight.

22. A composition as claimed in claim 1, wherein the ethoxylated non-ionic detergent conforms to the formula $R_4$-$(C_4H_6)X$ -$(OCH_2CH_2)M$ -OH wherein X is zero or 1, $R_4$ is an alkyl group having from 6 to 20 carbon atoms and M ranges from 2 to 30, and has a concentration in the whole composition within the range of from 12 to 55 per cent by weight.

* * * * *